US010647927B2

(12) United States Patent
Zuckerman

(10) Patent No.: US 10,647,927 B2
(45) Date of Patent: May 12, 2020

(54) CHEMICAL REJUVENATION PROCESS TO PERMANENTLY INCREASE THE API GRAVITY OF CRUDE OIL AND BITUMEN

(71) Applicant: DPD Chemical Inc., Imperial, MO (US)

(72) Inventor: Mathew M. Zuckerman, Carbondale, CO (US)

(73) Assignee: DPD Chemical Inc., Imperial, MO (US)

( * ) Notice: Subject to any disclaimer, the term of this patent is extended or adjusted under 35 U.S.C. 154(b) by 0 days.

(21) Appl. No.: 16/507,718

(22) Filed: Jul. 10, 2019

(65) Prior Publication Data

US 2019/0330542 A1 Oct. 31, 2019

Related U.S. Application Data

(62) Division of application No. 16/024,440, filed on Jun. 29, 2018.

(60) Provisional application No. 62/526,917, filed on Jun. 29, 2017.

(51) Int. Cl.
*C10G 29/22* (2006.01)

(52) U.S. Cl.
CPC ..... *C10G 29/22* (2013.01); *C10G 2300/308* (2013.01)

(58) Field of Classification Search
CPC ..... C10G 29/22; C10G 2300/308
See application file for complete search history.

(56) References Cited

U.S. PATENT DOCUMENTS

2003/0051988 A1* 3/2003 Gunnerman ..... C10G 31/00 204/157.15
2016/0177691 A1* 6/2016 Benson ..... E21B 43/2406 166/272.3

OTHER PUBLICATIONS

Alboudwarej, H, et al., "Highlighting Heavy Oil" Oilfield Review, pp. 34-54 (2006).
Buckley, J. S. And Wang, J. "Crude Oil and Asphaltene Characterization for Prediction of Wetting Alteration" Journal of Petroleum Science and Engineering, vol. 33, Issue 1-3, (2002).
Speight, J. "The Chemistry and Technology of Petroleum", CRC Press (1999).

* cited by examiner

*Primary Examiner* — Randy Boyer

(57) ABSTRACT

The invention relates to a method of increasing the American Petroleum Institute (API) gravity of feedstocks by reacting one or more mono-cyclic ether solvents such as oxolane with the asphaltene resident in bitumen or crude oils, at an ambient or elevated temperature, and at ambient or elevated pressure, to increase the API gravity and the economic value of the bitumen or crude oil, and a method for in situ manufacturing a mono-cyclic ether, oxolane, to rejuvenate bitumen or heavy crude oils into their younger lighter crude oils by blending methyl linoleate and methanol in a ratio; heating to produce oxolane; and contacting the oxolane as a solvent with the asphaltene resident in bitumen and heavy crude oils to release not only aromatic compounds, represented by toluene, but also the paraffinic alkanes, represented by n-heptane, making the feedstocks ready for extraction, separation of sand, pipeline transport and refining.

4 Claims, 10 Drawing Sheets
(9 of 10 Drawing Sheet(s) Filed in Color)

Enhanced Oil Recovery (EOR)

Steam Injection

Temporary

HEAT

COOL

Oxolaned Enhanced Steam™ Injection

Permeant

HEAT

COOL

| | | Venezuelan Crude<br>Puerto La Cruz, Anzo Tegui State | | | Blend<br>Eagle Ford Light<br>RVP < 8.6 psi |
|---|---|---|---|---|---|
| | | Heavy<br>Merey Heavy | Intermediate<br>Porta La Cruz | Difference, %<br>100 X ( 1 - 2) / 1) | 1 : 1 By Volume<br>With Column 1<br>API = 58.8$^0$ |
| Column | | 1 | 2 | | |
| API Gravity | $^0$ | 14.7 | 24 | -63 | 36.5 |
| Sp. Gr. @100 F | gm/cm$^3$ | 0.968 | 0.91 | 6 | |
| Kin. Visc. @ 100 F | cSt | 992 | 31.5 | 96.8 | |
| Asphaltenes | wt % | 8.68 | 4.78 | 50 | |
| Pour Point | $^0$F | 10 | -20 | 300 | |

FIG. 4

CHEMICAL REJUVENATION PROCESS TO PERMANENTLY INCREASE THE API GRAVITY OF CRUDE OIL AND BITUMEN

The current application is a divisional (DIV) application of a U.S. non-provisional application Ser. No. 16/024,440 filed on Jun. 29, 2018. The U.S. non-provisional application Ser. No. 16/024,440 claims a priority to a U.S. provisional application Ser. No. 62/526,917 filed on Jun. 29, 2017.

FIELD OF INVENTION

The present invention relates generally to a process of chemically reversing the effects of bacteria action, occurring over millenniums of time, resulting in the formation of asphaltene, that when present converts light crude oil to bitumen or heavy crude oil that resembles, chemically and texturally, the residue generated by the heavy distillate produced in a petroleum refinery that is a residual present even in light crude oil.

Specifically, the invention relates to a method of increasing the American Petroleum Institute (API) gravity of feedstocks by reacting one or more mono-cyclic ether solvents such as oxolane with the asphaltene resident in bitumen or crude oils, at an ambient or elevated temperature and ambient or elevated pressure to increase the API gravity and the economic value of the bitumen or crude oil.

The present invention also relates specifically to a method of in situ manufacturing a mono-cyclic ether solvent such as oxolane to increases the API gravity of feedstocks by reacting with the asphaltene resident in bitumen and heavy crude oils to increase the economic value, and ability to gravity separate sand from the crude, of these materials.

BACKGROUND OF THE INVENTION

Bitumen and heavy crude oil are characterized by high viscosity and low American Petroleum Institute (API) gravity. These characteristics result in higher costs for extraction, gravity separate sand, transportation, and refining than the costs associated with conventional light crude oil.

Bitumen, defined as an API Gravity less than 10 degrees, and heavy crude oil are the remnants of very large volumes of conventional light crude oils that have been generated and degraded, principally by bacterial action (Speight, J. 1999). Bitumen and heavy crude oil, chemically and texturally resemble the residual generated by refinery distillation of crude oil. The resource base of bitumen and heavy crude oil is immense and not a constraint on the expansion of production. These resources can make an important contribution to future oil supply if they can be extracted and transformed into usable refinery feedstock at sufficiently high rates and at costs that are competitive with alternative methods. Another possible heavy petroleum reserve is the four tar lakes in the world. The Guanaco Lake in Venezuela is slated to be harvested for removal of its estimated 75 million barrels of tar.

Bitumen and Heavy Crude Oil

The total in-place heavy crude oil and bitumen is greater than the original light crude oil in place in the world's known conventional oil fields. The methods used in the commercially successful projects in Venezuela Orinoco Oil Belt, for extraction of heavy crude oil, and Canada's Alberta, for bitumen, are proven production strategies and technologies that are being considered for smaller deposits elsewhere. The commercial value achieved in these locations is likely to lead to exploration that could result in additional deposits and verification of larger resource volumes at identified deposits.

Outside of Canada, 367 bitumen deposits are reported in 22 other countries. The largest volumes of bitumen after Canada are in Kazakhstan and Russia: both countries are well endowed with less cost of extraction conventional crude oil. The worldwide volumes of discovered bitumen are 2,511 billion barrels.

According to the International Energy Agency (IEA), the estimated volumes of heavy crude oil worldwide are about 6 trillion barrels, of which 2.5 trillion barrels are in Canada, 1.5 trillion barrels are in Venezuela, 1 trillion barrels are in Russia and 100 to 180 billion barrels are in the USA. The recovery of heavy crude oil is commonly practiced in countries such as USA, Canada and Venezuela. Heavy oil is recorded in 162 deposits located in 21 countries. A map of a major heavy crude oil deposits, the Orinoco oil belt in the Eastern Venezuela basin, is shown in FIG. 1. Heavy crude oil production accounts for more than 20% of Venezuela's oil production. Some fields are comprised only of heavy crude oil reservoirs whereas other such reservoirs occur in fields producing mainly from conventional light and intermediated crude oil reservoirs.

Venezuela blends its crude oil to produce and to export products, one tests to API of 30 degrees and is refinery ready, and the other, Merey-16, tests to an API of 16 degrees. The Merey-16 sells at ten dollars less per barrel than the API gravity of 30 degrees.

Characteristics of Crude Oil

No crude oil has ever been completely separated into its individual component chemicals. For example, a total of 141 component chemicals were identified in one sample of crude oil from Oklahoma. But these compounds only accounts for 44% of the total individual component chemicals in the crude. The component chemicals in crude oil are classified into paraffinic, aromatic and napthenic groups (Speight, J. 1999). Paraffin hydrocarbons are characterized by open or straight chains of carbons, joined by single bonds. The first four paraffin hydrocarbons are: methane, ethane, propane and butane. The isomers of these compounds, contain branched chains, are also paraffins. The first four members are gases at room temperature and pressure. Compounds ranging from pentane ($C_5H_{12}$) through heptadecane ($C_{17}H_{36}$) are liquids, while the heavier members are colorless, wax-like solids. Unsaturated hydrocarbons, with one or more double or triple bond between the carbons, consist of olefins, diolefins, and acetylenes. These compounds are highly reactive and are not normally present to any great extent in crude oil. Naphthene hydrocarbons are ringed molecules and are also called cycloparaffins. These compounds, like the paraffins, are saturated and very stable and make up the second primary constituent of crude oil. Aromatic hydrocarbons, derivatives of benzene, are also cyclic. The rings are characterized by alternating double bonds and, in contrast to olefins, are quite stable, though not as stable as paraffins. Crude oils are complex mixtures of these hydrocarbons. Oils containing primarily paraffin hydrocarbons are called paraffin-based or paraffinic. Naphthenic-based crudes contain a large percentage of cycloparaffins in the heavy components. Highly aromatic crudes are less common but are still found around the world. Crude oils tend to be a mixture of aromatic compounds of paraffin and naphthene, with paraffins and naphthenes the predominant species.

Paraffinic Asphaltenes in Crude Oil

Asphaltenes, present in crude oil, are the black color components of relatively high-molecular-weight that are characterized as polar, polycyclic, aromatic ring compounds. Pure asphaltenes are nonvolatile, dry, solid, black powders. Asphaltenes do not dissolve in crude oil but exist as a colloidal suspension. They are partially soluble in aromatic compounds such as xylene, but will precipitate in the presence of light paraffinic compounds such as pentane or naphtha.

FIG. 2 compares and contrasts the chemical composition, based on number of carbons in the compounds, of natural gas and crude oil and further identifies tars and its subset asphaltenes in the crude oil. While not totally definitive, it can be observed that heavy crude oils, with lower API gravities, tend to be more naphthenic, while light crude oils, with higher API gravities tend to be more paraffinic. This is illustrated in FIG. 2 by an arrow to the right that indicates that heavy crude oil contains more naphthenic hydrocarbon compounds and an arrow to the left indicating the light/intermediate crude oil contains more paraffinic hydrocarbons compounds.

One of the main challenges associated with production of heavy crude oil is transportation of the oil by pipelines, particularly without the prior reduction of the oil viscosity to acceptable levels to ensure oil fluidity in pipelines. Light crude oil, or one of its distillates, such as naphtha, heavy naphtha or kerosene, or diesel is used as a blend stock to reduce the viscosity and thus increase the API gravity of heavy crude oil. In one example, the viscosity of heavy crude oil was reduced from 4,000 to 500 cSt: an 88% reduction. However, delayed asphaltene precipitation (DAP) is often associated with blending. One blending formula effective in reducing the viscosity of heavy crude oil, without resulting in DAP, is 0.5 to 2.0 weight percent of a mixture of n-hexane and toluene. There is a need to deconstruct the asphaltene to liberate its n-hexane and toluene fractile building blocks and allow these compounds to migrate into the general population of compounds to reduce the viscosity of the crude oil, allowing pipeline transport, and avoiding the complexities/cost of purchasing these compounds for blending of the internally generated compounds that are superior to blending with heavy naphtha or other distillates that produce harmful DAP.

Specific Gravity (SG) as a Function of API Gravity

The American Petroleum Institute gravity, or API gravity, is a measure of how heavy or light a petroleum liquid is compared to water: if the API gravity of a crude oil is greater than 10, it floats on water; if it is less than 10, it is heavier and sinks. API gravity values of most petroleum liquids fall between 10 and 70 degrees. The formula to calculate API gravity from a known specific gravity (SG) is:

$$API\ \text{Gravity} = \frac{141.5}{SG} - 131.5$$

Conversely, the SG of petroleum liquids can be derived from known API gravity value as:

$$SG\ @\ 60\ ^\circ\text{F.} = \frac{141.5}{API\ \text{Gravity} + 131.5}$$

Thus, a heavy crude oil with a specific gravity of 1.0, with the same density as pure water at 60° F., has an API gravity of 10. The following table contains the SG @ 60° F. for specific petroleum liquids at incremental API degrees.

| API Degrees | Specific Gravity |
|---|---|
| 1 | 1.0680 |
| 5 | 1.0370 |
| 8 | 1.0140 |
| 10 | 1.0000 |
| 15 | 0.9659 |
| 20 | 0.9340 |
| 25 | 0.9042 |
| 30 | 0.8762 |
| 35 | 0.8498 |
| 40 | 0.8251 |
| 45 | 0.8017 |
| 50 | 0.7796 |
| 55 | 0.7587 |
| 60 | 0.7389 |
| 70 | 0.7022 |
| 80 | 0.6690 |
| 90 | 0.6388 |

Kinematic Viscosity as a Function Specific Gravity (SG)

Centistokes (cSt), are the units for measurement of the kinematic viscosity, which is the absolute viscosity, measured in centipoise (cP) of the petroleum divided by the SG.

$$\text{Kinematic Viscosity (cSt)} = \text{Absolute Viscosity (cP)} / \text{Specific Gravity}$$

Since most crude oil have SG between 0.8 and 1.0, the value of absolute viscosity (cP) is often smaller than the value of the kinematic viscosity (cSt).

Asphaltene

Petroleum engineers harbor the assumption that asphaltene constitutes a colloidal size fraction of dead, unavailable as petroleum liquid, fraction of crude oil: like suspended fine solids. This leads to the persistent generalization that the decrease in API gravity is a function of the increase in the crude oil's asphaltene content (Buckley and Wang, 2002).

The following equation for SG as a function of asphaltene content in grams per liter was derived by fitting a line to the physical chemical data for 500 plus crude oil samples.

$$SG = 0.78 + 0.0054 \times C^{0.61}$$

Where: C is the asphaltene content of the crude oil in grams per liter Conversely, the asphaltene content of the crude oil can be derived from their API gravity value as:

$$\text{Asphaltene Content, g/l} = \sqrt[0.61]{\frac{(SG - 0.78)}{0.0054}}$$

API, Specific Gravity, Viscosity and Asphaltene Content

The physical chemical characteristics of a Venezuelan heavy crude oil for Block C North are as follows: API Degrees is 8 @ 60° F., Absolute Viscosity is 5,000 (cP) @ 100° F., and Transportation Temperature is 180° F. The maximum viscosity to allow crude oil to be transported is a kinematic viscosity between 250 to 400 cSt: depending on the pipeline. The assumption is made that the heavy crude requires heating to 180° F. to be moved and this corresponds to a kinematic viscosity of 400 cSt. Therefore, the following calculations can be made:

$$API \text{ Degrees of } 8 = \text{Specific Gravity of } 1.014$$

$$\text{Kinematic Viscosity } (cSt) = \frac{5{,}000 \text{ cP}}{4{,}931\ cSt},$$

$$\text{Absolute Viscosity}/1.014,\ SG =$$

$$\text{Asphaltene Content, g/l} = \sqrt[0.61]{\frac{(SG - 0.78)}{0.0054}} = 17.1 \text{ g/l}$$

The kinematic viscosity of 400 cSt is required to move the crude. This is obtained, as stated above, by heating to 180° F. The proposed in the present invention is a treatment that allows the movement of the crude at a lower temperature by changing the chemical composition of the crude and has the potential, at sufficient dosage, to allow movement of the crude at ambient temperature and obtain an API of sufficient large value to allow the crude to be "refinery ready".

Steam Injection for Enhanced Oil Recovery and Chemicals as Supercritical Fluids

The most common thermal technologies used for enhanced oil recovery of heavy crude oil are steam flood and cyclic steam stimulation (Alboudwarej, H., 2006).

The steam flooding process involves steam injection through injection wells to an oil reservoir. The areas around the injection wells are heated up to steam temperature. The steam front starts condensing to hot water which still conducts heat to the system, at lower level than steam, and drives oil toward production wells. The process becomes more efficient if thermal communications are established between the injection and production wells. The oil production, then, becomes more fluent as its viscosity is significantly reduced.

Cyclic steam stimulation, also known as "huff-and-puff" involves the injection of steam into a reservoir for some time and then shutting in the well for sufficient time. This enables steam to soak, and therefore, heats the reservoir and mitigates oil mobility. After some time, the well is allowed to flow and production is resumed. This process may be repeated for several times until production of certain volumes of injected fluid or the reservoir pressure is decreased.

The conditions of down well steam injection achieve temperatures and pressure conditions that transform solvent chemicals into supercritical fluids: because these conditions are above the critical point for these materials. The distinct liquid and gas phases do not exist above the critical point as shown in the following table.

| | Density ($kg/m^3$) | Viscosity ($\mu Pa \cdot s$) | Diffusivity ($mm^2/s$) |
|---|---|---|---|
| Gases | 1 | 10 | 1-10 |
| Supercritical Fluids | 100-1000 | 50-100 | 0.01-0.1 |
| Liquids | 1000 | 500-1000 | 0.001 |

The solvent effuses through the solids like a gas and dissolves materials in the asphaltene like a liquid. The extraction of the aromatic and alkane chain carbon materials from the asphaltene occurs at an accelerated rate due to the low viscosity and high diffusivity associated with supercritical fluids. The following table contains critical temperature characteristics for some solvent chemicals.

| Solvent | Molecular weight g/mol | Critical temperature K | Critical pressure MPa (atm) | Critical density $g/cm^3$ |
|---|---|---|---|---|
| Carbon dioxide (CO2) | 44.01 | 304.1 | 7.38 (72.8) | 0.469 |
| Oxolane $(CH_2)_4O$ | 72.1 | 541 | 5.19 (51.2) | |
| Methanol (CH3OH) | 32.04 | 512.6 | 8.09 (79.8) | 0.272 |

Two factors have made light crude less available over the decades. First, light crude was the first crude and second the demand for light crude to blend with heavy crude and bitumen is accelerating the demand of light crude oil: as these reserves are becoming a larger part of our petroleum supply. There is a need for an alternative to blending light crude with heavy crude and bitumen. If this alternative was a derivative of vegetable oil then it would be renewable and practically inexhaustible and would lessen the current high demand for light crude oil: allowing heavy crude and bitumen to have unrestricted access as a source for the world's petroleum supplies.

OBJECTS OF THE INVENTION

An object of the present invention is that asphaltene deconstruction is achieved with oxolane $(CH_2)_4O$, a moderately bipolar solvent, thus avoiding need to add detergent or micelles present in the sub 100 Kauri-butanol (K-b) value solvents used for down well applications, that first breaks through the shell of resin that incases the asphaltene by the polar portion of the molecule attaching and oxidizing the resin and then by the non-polar portion moving through the asphaltene, to release the aromatic fractions represented by toluene and then releases the paraffinic alkanes fraction represented by n-heptane.

Another object of the present invention is that the asphaltene deconstruction results in a permanent change in viscosity. Illustrated in FIG. 3 is that the viscosity of heavy crude oil decreases with the temperature associated with injection of steam in Steam Flood and Cyclic Steam Stimulation. On the injection of steam, the viscosity of the heavy crude oil decreases as the temperature increases. The reverse occurs on cooling of the heavy crude oil. Therefore, the decrease in viscosity of the heavy crude oil was only temporary. However, when the steam is doped with oxolane it becomes oxolaned enhanced steam, and on injection the heavy crude oil's viscosity decreases at elevated temperature is locked in because oxolane decomposes asphaltene into lighter petrochemical compounds, that find use as fuels, and this low viscosity does not increase as the temperature of the crude oil returns to ambient temperature. It is as if time has been turned back and the heavy crude returns to its comparative youth as intermediate or light crude oil.

A further object of the present invention is control of workers exposure to oxolane. Oxolane's OSHA legal limit for airborne permissible limit (PEL) is 200 ppm over an 8 hour work shift. By conducting the manufacture of the solvent for asphaltene/tar deconstruction in situ the formation is confined to the storage tank or down well. Exposure is further reduced because the oxolane is eliminated as the deconstruction of the asphaltene progress. The components are shipped to the geographic location separately as an ester of corm oil and methanol that is a material routinely commercially transported. At the point of the components are blended by mixing 1.6 parts of methyl linoleate by weight and 1 part of methanol by weight, the formation of oxolane does not occur until heat is applied at 60° C. in the above ground embodiment and several hundred degrees centigrade in the down well embodiment.

A still further object of the present invention is that the oxolane effectively delivers the enhanced solvent power over the unsaturated comparatively long carbon chain linolenic fatty acid or its methyl ester. Linoleic fatty acid (18:2) as a source material is preferred to linolenic fatty acid (18:3) for linoleic fatty acid (18:2) has greater oxidative stability. Oxolane is a small, molecular mass of 72 Da, as compared to the molecular mass of its precursor methyl linoleate, molecular mass of 294 Da. Since solvent power increases as the molecular mass decreases, then oxolane with only 25% of the molecular mass of its precursor methyl linoleate has a greater solvent power that can be applied to the task of decomposition of asphaltene.

A further object of the present invention is to avoid a detrimental change to the thermal fraction profile of the crude that would occur if the carbon to carbon single bond of medium chain and long chain alkanes were to be oxidized in a hydrolysis process resulting in shorter chain length alkanes by matching the mono-cyclic ether solvent to the resin "egg shell" of the asphaltene, present in a minor weight percent of ten percent (10%) or less, that poses a characteristic lower Gibbs free energy, so that is favored for the occurrence of oxidation, that the carbon to carbon bond in the medium and long chain alkanes present in the bulk of the crude oil.

SUMMARY OF THE INVENTION

The present invention employs a novel and no-obvious combination of elements to rejuvenate bitumen or heavy crude oils into their younger lighter crude oils so that the API remains high after the extracted crude cools that increases the API gravity of feedstocks by reacting a mono-cyclic ether solvent with the asphaltene resident in bitumen and heavy crude oils, at an elevated temperature, to increase the economic value of these materials so that the increased value of API remains high after the extracted crude cools to allow extraction, separation of sand, transportation, and refining.

In the present invention, one or more mono-cyclic ethers serving as a chemical super solvent, are in situ manufactured in underground deposits by enriching injection steam or by pump injection into above ground storage tanks to transform bitumen or heavy crude oil into to crude oil with higher API gravity by deconstruction asphaltene that frees not only aromatic compounds but also the parafinic alkanes, making the feedstocks ready for transport and refining. The following table contains the four mono-cyclic ethers (i.e., oxirane, oxetane, oxolane and oxane).

Epoxides and Mono-Cyclic Ethers

| | Common Name | Formula | Mass Daltons | Dielectric Constant | Dipole Moment | Boiling Point, C. | % Oxygen By Weight |
|---|---|---|---|---|---|---|---|
| Oxirane | Ethylene Oxide | $C_2H_4O$ | 44.05 | 13.9 | 1.89 | 10.7 | 36 |
| Oxetane | Trimethylene Oxide | $C_3H_6O$ | 58.08 | | 1.93 | 50 | 28 |
| Oxolane | Tetrahydrofuran (THF) | $C_4H_8O$ | 72.1 | 7.58 | | 66 | 22 |
| Oxane | Tetrahydropyran (THP) | $C_5H_{10}O$ | 86.1 | 9 | | 88 | 19 |

Linoleate and methanol are reacted, at a volumetric ratio of 1.6 to 1, at a temperature of 60° C., and pressure of 1 bars (15 psi), to produce oxolane, which would increase the API gravity of the crude by contacting the reaction products, now a solvent, with the asphaltene in the feedstock.

In an embodiment of the present invention, the oxolane is in situ manufactured for treatment of heavy crude oil or bitumen to react with asphaltene by injection of steam mixed with methyl linoleate and methanol, at a volumetric ratio of 1.6 to 1, that achieves superfluid status at a temperature of 300 to 400° C., and pressure of 300 bars (4,400 psi), to increases in API gravity of the crude mixture.

Ethylene Oxide (oxirane or epoxide), is a gas at ambient conditions of temperature/pressure, has a boiling point under pressure that allows the compound to be utilized as a liquid because the compound's vapor pressure increase with pressure. At two atmospheres the boiling point is 57.7 C, and at ten atmosphere the boiling point is 114 C.

In a preferred embodiment is to react the oxirane with alcohols, in the process of alkoxylation, to produce a chemical that is a liquid allowing contact with the crude oil to produce an increase in API gravity. The class of chemicals produced is called alcohol ethoxylates. The chemical formula for alcohol ethoxylates is $R(OC_2H_4)_nOH$, where n is a whole number in the range of 1 to 10. Representative of these compounds is C9-11.

DESCRIPTION OF THE DRAWINGS

The patent or application file contains at least one drawing executed in color. Copies of this patent or patent application publication with color drawing(s) will be provided by the office upon request and payment of the necessary fee.

To further clarify the above and other advantages and features of the present invention, a more particular description of the invention will be rendered by references to specific embodiments thereof, which are illustrated in the appended drawings. It is appreciated that these drawings depict only typical embodiments of the invention and are therefore not to be limiting of its scope.

Figure 1:
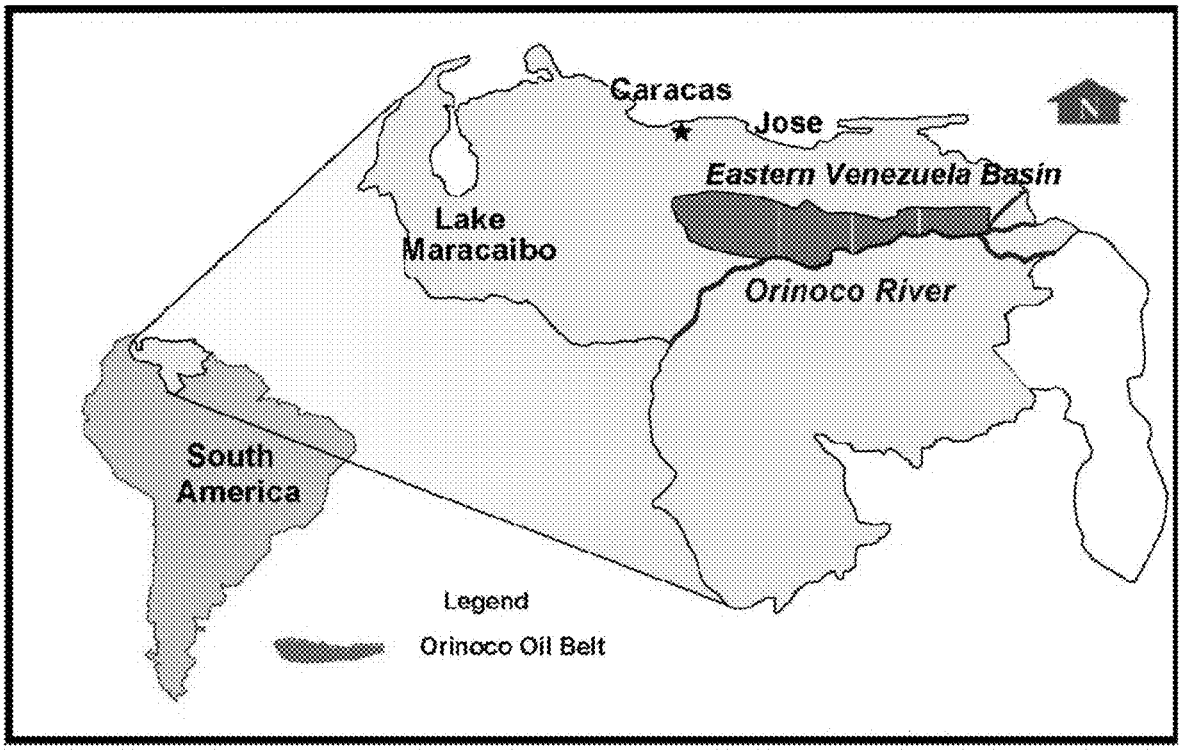

The invention will be described and explained with additional specificity and detail through the use of the accompanying drawings in which:

FIG. 1 shows the geographic location of Venezuela's heavy crude oil reserves. The government of Venezuela has partitioned the heavy oil belt into six areas and subdivided the areas into blocks which have become the project units. The plan is to start enhanced recovery methods after the cold production phase. Enhanced Oil Recovery primarily uses injected steam. New projects are required to include upgrading facilities, located near the coast. The unit supply cost for the Orinoco extra-heavy oil produced cold with multilateral wells is much lower than Canadian production costs of bitumen because favorable fluid and reservoir conditions result in sustained high production rates per well. Current estimates of the supply costs for the Orinoco extra-heavy crude oil are as little as one-third of Canadian Bitumen supply costs.

Figure 2:
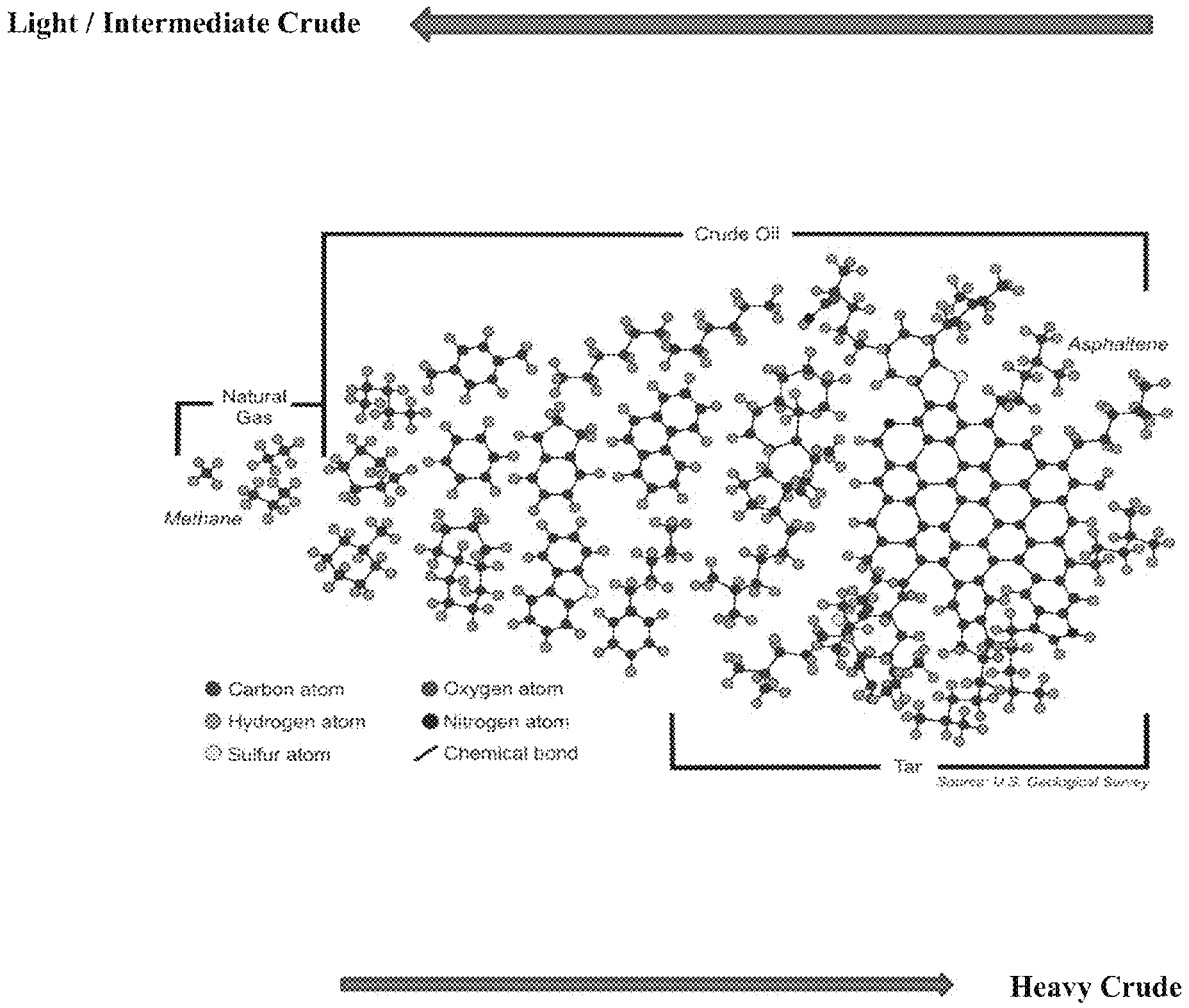

FIG. 2 compares and contrasts the chemical composition, based on number of carbons in the compounds, of natural gas and crude oil and further identifies tars and its subset asphaltenes in the crude oil.

Figure 3:
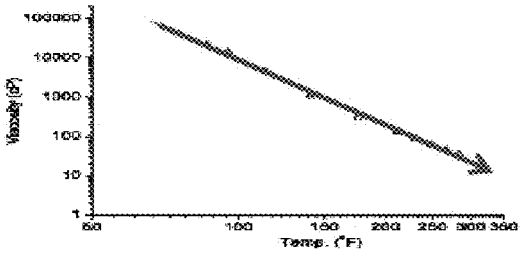
Figure 3:
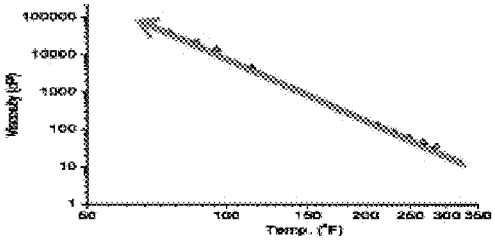
Figure 3:
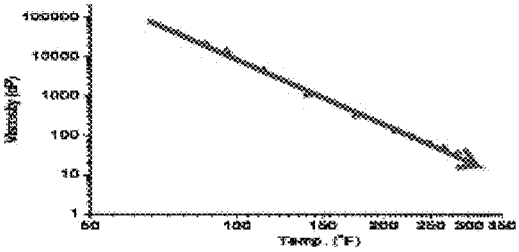
Figure 3:
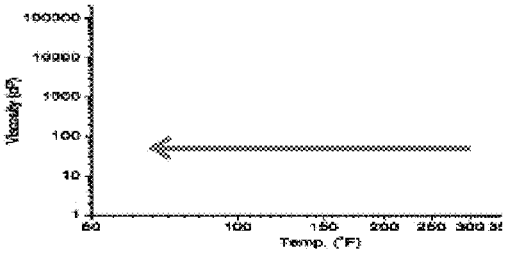

FIG. 3 utilizes the graphs of crude oil's viscosity vs. temperature to compare the temporary benefits of viscosity reduction of enhanced oil recovery with conventional steam injection to the permanent viscosity reduction with oxolaned enhanced steam injection.

FIG. 4 compares key parameters of crude oil classified as heavy and intermediate extracted from wells in the same Venezuelan geographical location, and a blend crude oil suitable for refining, produced by blending the heavy crude oil with a light crude oil.

Figure 5:
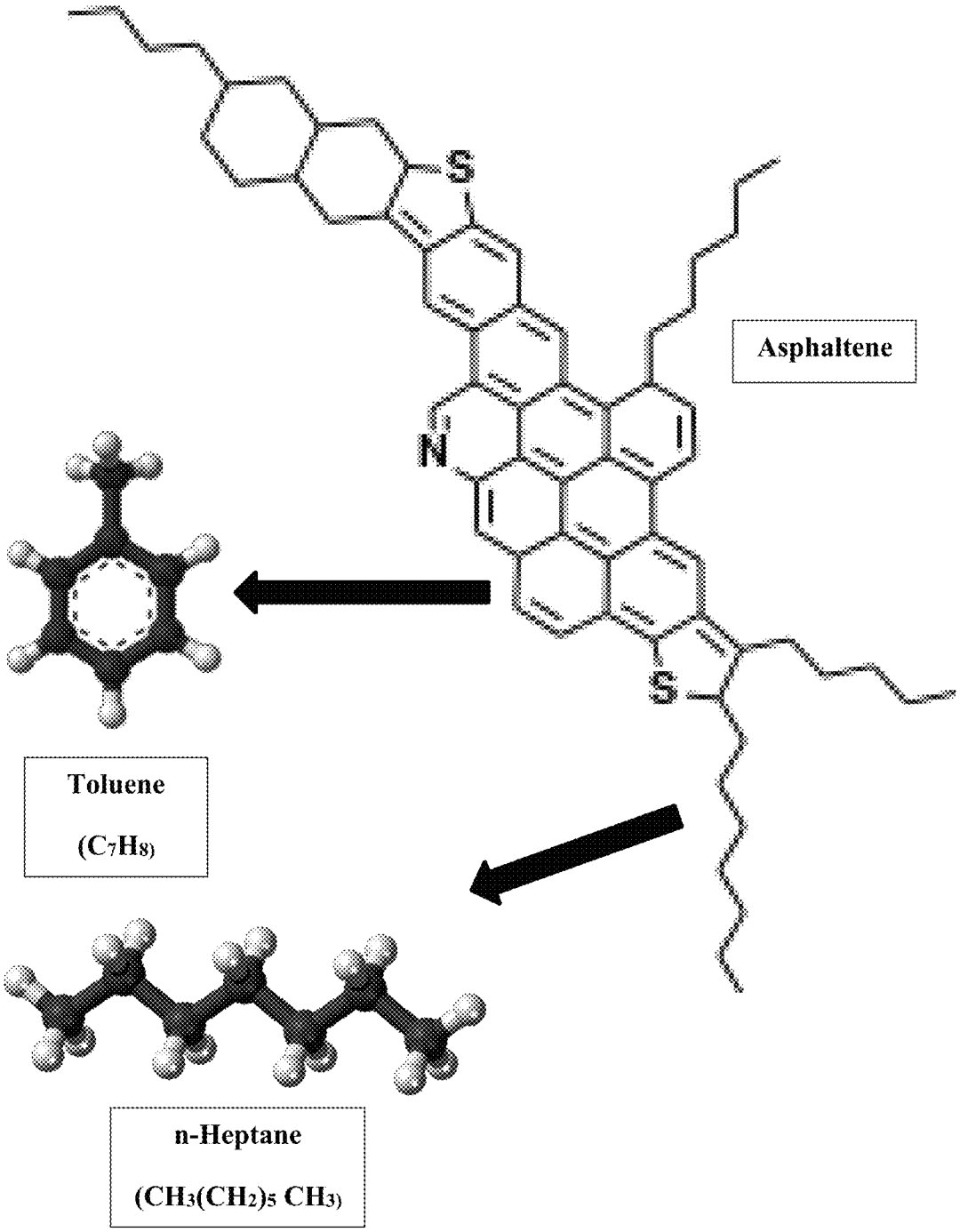

FIG. 5 illustrated is that asphaltene, found in crude oil and bitumen, can be operational defined as composed of the petrochemical soluble toluene and the petrochemical insoluble n-heptane.

Figure 6:
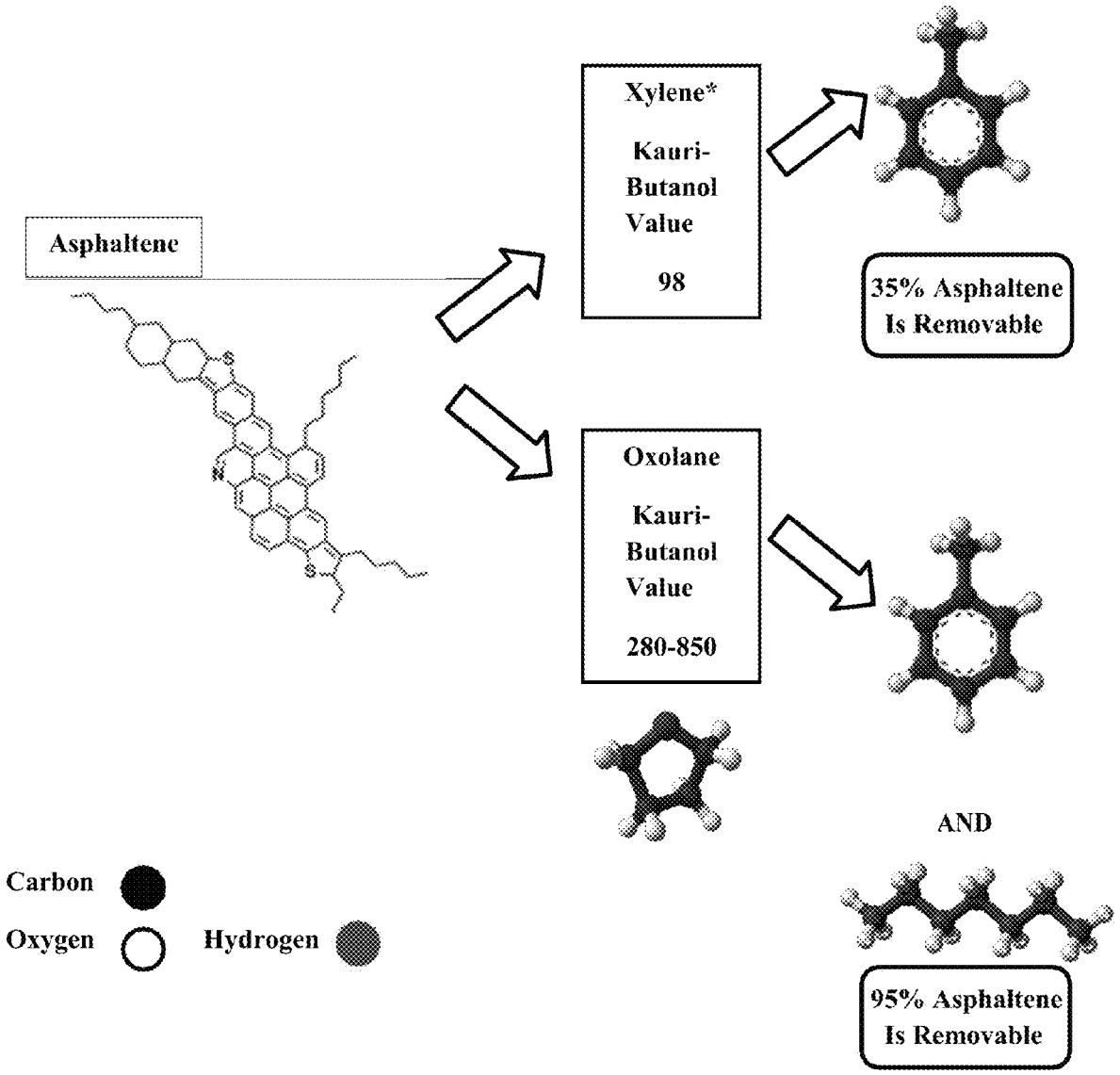

FIG. 6 illustrates the degree of dissolution of asphaltene by the solvent xylene as compared to the solvent oxolane.

Figure 7:
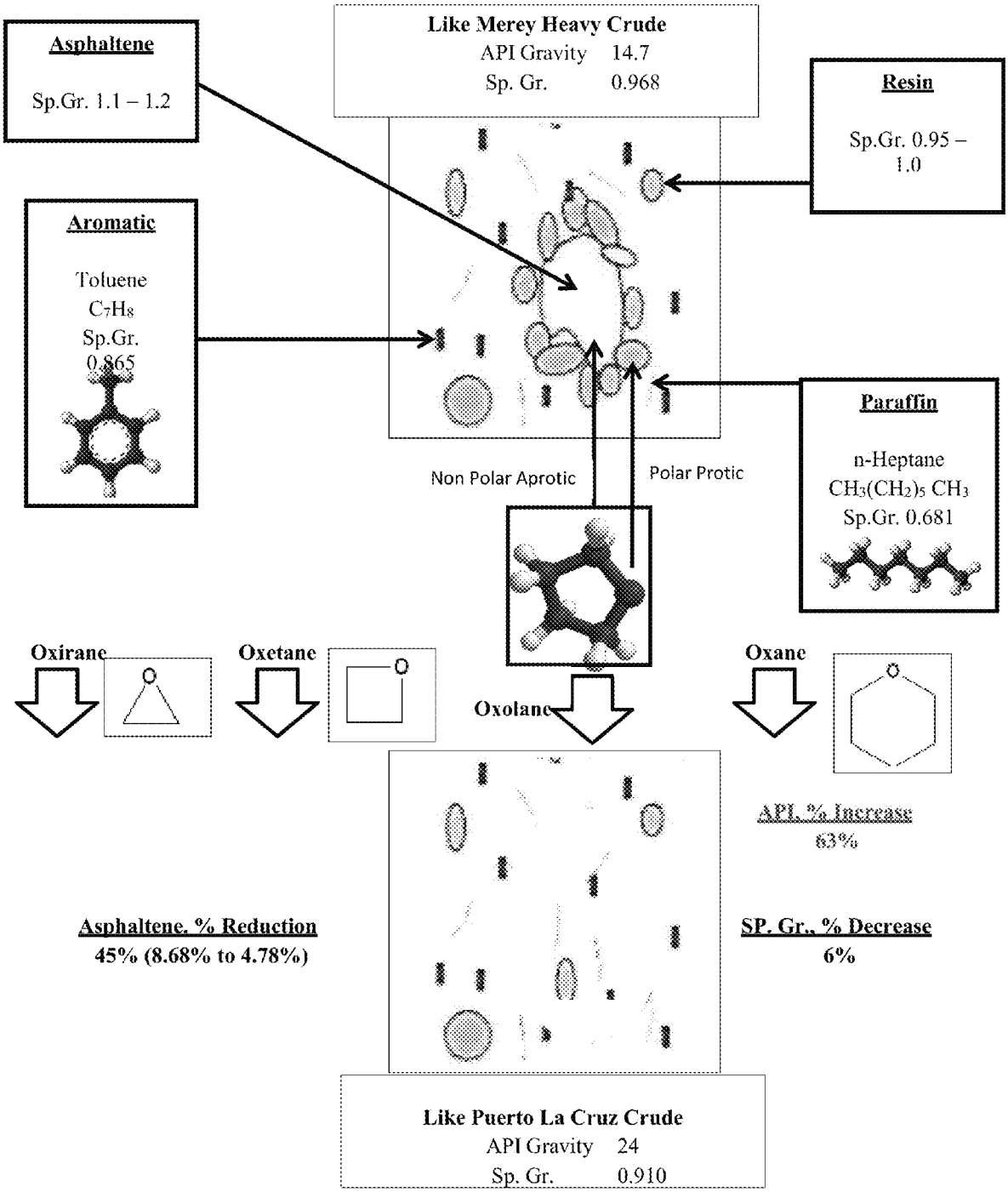

FIG. 7 is a simulation of the performance of the mono-cyclic ether solvents on the destruction of Merey heavy crude into Puerto La Cruz intermediate crude.

Figure 8:
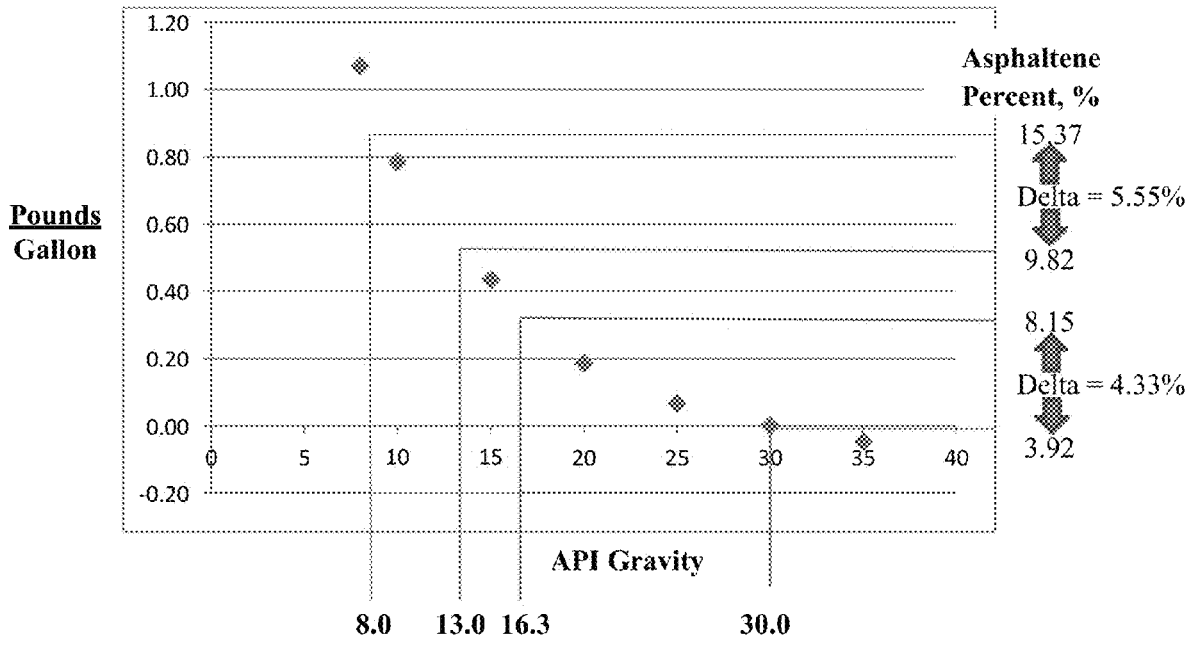

FIG. 8 is a graphical representation of the relationship between the quantity of asphaltene required to be deconstructed from heavy crude oils to achieve an API of 30 Degrees and Example Two.

Figure 9:
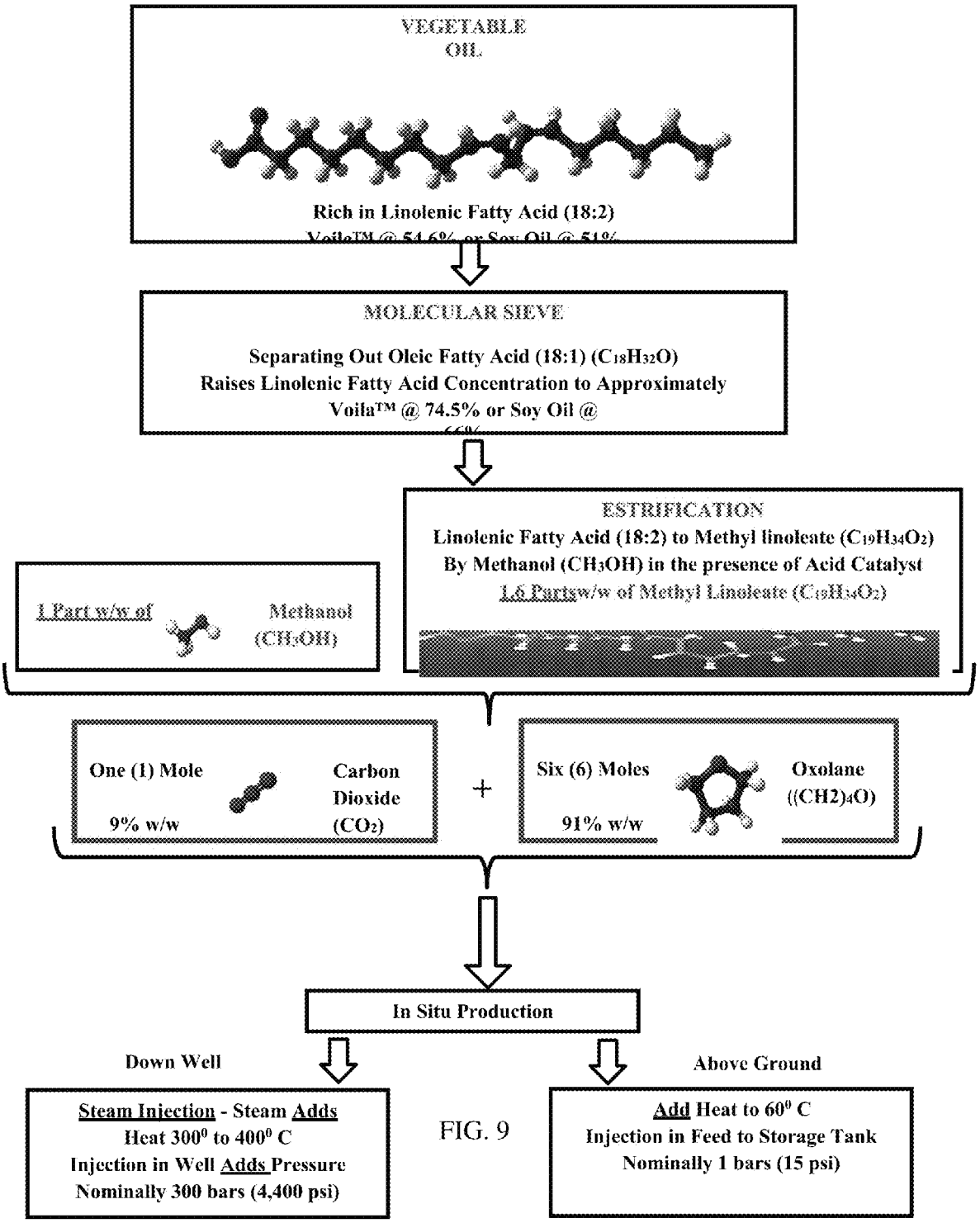

FIG. 9 is a process diagram for preferred embodiments of the present invention where the oxolane solvent is produced in situ either down well and on the surface.

Figure 10:
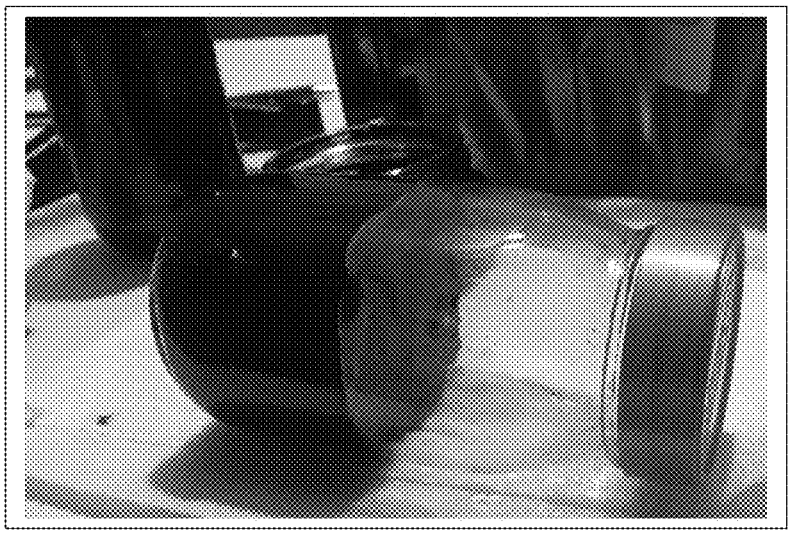
Figure 10:
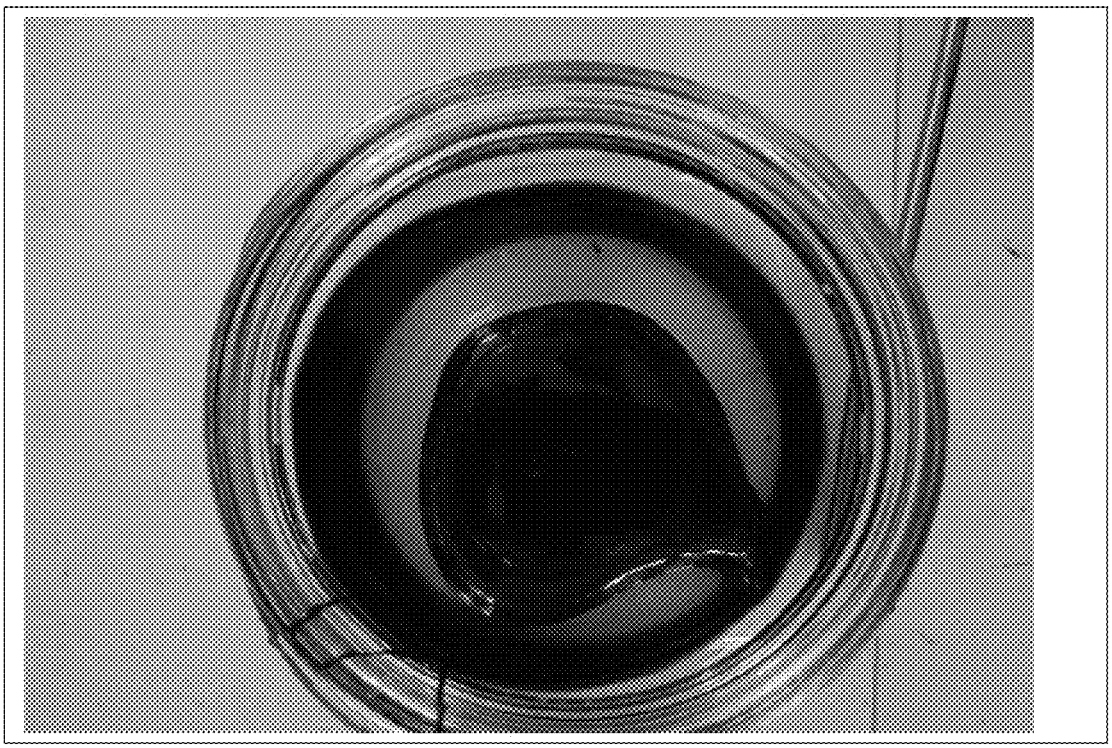

FIG. 10 illustrates Lake Guanoco Venezuela Crude Oil with API gravity of 4 degree (top graph), and bird's eye view of asphaltene crude being treated (bottom graph).

DETAILED DESCRIPTION OF THE INVENTION

Asphaltene deconstruction is achieved with oxolane $(CH_2)_4O$, a moderately bipolar solvent, thus avoiding need to add detergent or micelles present in the sub 100 Kauri-butanol (K-b) value solvents used for down well applications, that first breaks through the shell of resin that incases the asphaltene by the polar portion of the molecule attaching and oxidizing the resin and then by the non-polar portion moving through the asphaltene, to release the aromatic fractions represented by toluene and then releases the paraffinic alkanes fraction represented by n-heptane.

As shown in FIG. 4, to obtain an intermediate crude with API of 36.5°, that is suitable for refining, the heavy crude with API of 14.7° is blended in a one to one volumetric ratio with light crude with API gravity of 58.8°. Also shown is that the same Venezuelan geographic location produces both heavy crude oil and intermediate crude oil. The analyses of these two oils indicate that the heavy crude oil with API of 14.7° contains 8.68% asphaltene and the light crude oil with API of 24° contains 4.78% asphaltene. The heavy crude oil has been exposed to bacterial action for longer time than the light crude and during this time the asphaltene content has almost doubled. If the asphaltene content in the heavy crude oil can be deconstructed into lighter compounds, then the oil would experience rejuvenation and intermediate crude oil would be resulted in, avoiding the need for light crude oil blending to produce a similar result.

Asphaltene is a carbonaceous material found in crude oil, bitumen, and coal. Asphaltene, with a C:H ratio of approximately 1:1.2 and a distribution of molecular masses in the range of 400 Daltons (33 carbons) to 1500 Daltons (125 Carbons), is extremely complex mixtures containing hundreds or even thousands of individual chemical compounds. As shown in FIG. 5, asphaltene is defined operationally as the n-heptane ($C_7H_{16}$), oil insoluble, and toluene ($C_6H_5CH_3$), oil soluble.

Production of Parrafinic Wells

Solvents are classified as polar that dissolve in water and non-polar that dissolve in oil. The Kauri-butanol value, obtained by ASTM D1133-13 test, is used to rate the power of solvents and is shown in parenthesis for the following solvents. Wells are plagued with loss of production when progressive pressure decrease occurs with accumulation of asphaltene and other material deposits in down well. Chemical treatment with diesel, hydrochloric acid and petroleum distillate solvents, such as xylene (99), are used to restore these wells production. In addition to the petroleum derived above mentioned materials, natural solvents have been used to restore these wells production. Among the natural solvents used are methyl 9-dodecenoate ($C_{13}H_{24}O_2$) (85), D-limonene ($C_{10}H_{16}$) (67), methyl laurate ($C_{13}H_{26}O_2$) (77), and methyl soyate (59).

In the present invention, one or more mono-cyclic ethers serving as a chemical super solvent, are in situ manufactured in underground deposits by enriching injection steam or by pump injection into above ground storage tanks to transform bitumen or heavy crude oil to crude oil with higher API gravity by deconstruction of asphaltene to free not only aromatic compounds but also parafinic alkanes, making the feedstocks ready for transport and refining. The following table contains four mono-cyclic ethers (oxirane, oxetane, oxolane and oxane).

Epoxides and Mono-Cyclic Ethers

| | Common Name | Formula | Mass Daltons | Dielectric Constant | Dipole Moment | Boiling Point, C. | % Oxygen By Weight |
|---|---|---|---|---|---|---|---|
| Oxirane | Ethylene Oxide | $C_2H_4O$ | 44.05 | 13.9 | 1.89 | 10.7 | 36 |
| Oxetane | Trimethylene Oxide | $C_3H_6O$ | 58.08 | | 1.93 | 50 | 28 |
| Oxolane | Tetrahydrofuran (THF) | $C_4H_8O$ | 72.1 | 7.58 | | 66 | 22 |
| Oxane | Tetrahydropyran (THP) | $C_5H_{10}O$ | 86.1 | 9 | | 88 | 19 |

In the present invention, oxolane $(CH_2)_4O$, a mono-cyclic ether with a Kauri-butanol (K-b) value of 850, exceeds the power of previously used solvents for down hole applications by a sufficient multiplier to be used in the present invention to free not only aromatic compounds from the asphaltene, represented by toluene, but also the parafinic alkanes, represented by n-heptane as shown in FIG. 6. Wherein toluene, with K-b value of less than 100, is effective on the toluene in asphaltene to dissolve an estimated 35% by weight, and oxolane, with K-b value of 850, is effective on both the heptane and the toluene in asphaltene to dissolve an estimated 95% by weight.

FIG. 7 shows a simulation of the performance of the mono-cyclic ether solvents such as oxirane, oxetane, oxolane and oxane on the destruction of Merey heavy crude into Puerto La Cruz intermediate crude, where the Merey heavy crude oil, that has an API gravity of 14.7 b, has contacted with a mono-cyclic ether solvent, resulting formation of Puerto La Cruz crude oil with an API gravity of 24.

Polar solvents, such as methanol with a dielectric constant of 32.7, have large dipole moments: these solvents have bonds between atoms with very different electro negativities such as oxygen and hydrogen. Non-polar solvents, such as heptane with a dielectric constant of 1.92, have small dipole moments: these solvents contain bonds between atoms with similar electronegativity, such as carbon and hydrogen. Oxolane, 72.1 Da, that is representative of the small molecular family of epoxides, with a dielectric constant of 7.58, has a moderate dipole moment with a polar portion of the molecule useful as a solvent for the resin that surround the asphaltene, and the non-polar portion of the molecule useful as a solvent for the asphaltene. Oxirane which is the smallest of the family of mono-cyclic ether with a molecular weight of 44 Da, has a larger dielectric constant of 13.9 than that of oxolane and is therefore a better solvent. The carbons that occupy four of the five ring positions in the oxolane, and the carbon in the oxirane that occupies two out of the three ring positions are in addition to being non-polar are also aprotic, weakly reactive, for only hydrogen is bonded to the carbon. However, the oxygen that occupies one position in the oxolane ring, and one position in the oxirane ring, in addition to being polar is also aprotic, strongly reactive, for hydrogen is bonded to the oxygen. The latter portion of the oxirane and the oxolane that contains oxygen, strongly reactive, is the solvent that removes the polar resins from the asphaltene allowing the non-polar portion of the oxirane and the oxolane to act as a solvent on the asphaltene to liberate the toluene and hexane to reduce the specific gravity and to increase the API gravity.

Quantity of Asphaltene Deconstruction to Achieve API 30 Degrees

The Petrochemical Infrastructure, pipelines and refineries, is designed to accommodate crude oil with a minimum of API 30 based on the historically available light crude oil like West Texas Intermediate (WTI) crude with an API of 40. The present invention is capable of processing heavy crude oils to increase the API Degree sufficiently to obtain pipeline and refinery ready lighter crude oil with an objective of API 30 Degrees. The following table is prepared based on the physical characteristics of Puerto La Cruz and Merey heavy crude shown in FIG. 4.

| API | SG | Asphaltene Percent,% | Lb./Gal. | Removal to 30 API Degrees Lb./Gal. |
|---|---|---|---|---|
| 8 | 1.0140 | 15.95 | 1.35 | 1.07 |
| 10 | 1.0000 | 12.76 | 1.06 | 0.78 |
| 15 | 0.9659 | 8.86 | 0.71 | 0.43 |
| 20 | 0.9340 | 5.98 | 0.47 | 0.19 |
| 25 | 0.9042 | 4.59 | 0.35 | 0.07 |
| 30 | 0.8762 | 3.82 | 0.28 | 0.00 |
| 35 | 0.8498 | 3.28 | 0.23 | |
| 65 | 0.7206 | 0 | 0.00 | |

A graphic presentation of a subset of the above data is shown in FIG. 8. The table shows that the API Degree of a crude oil that has no asphaltene is estimated to be the light crude oil with an estimated value of 65. Based on data presented, to produce an intermediate crude oil with an API degree of 30, an intermediate crude oil with API degree of 25 required twenty nine percent (29%) of dosage of the epoxide solvent that is required for a heavy crude oil with API degree of 8.

Pipeline Transportation

Naphtha, a distillate with API gravity 65 degrees, is blended at a 10% volumetric dosage with Venezuelan crudes, API range of 8 to 60, to allow for pipeline transport. However, because of the inherent insolubility of asphaltene in naphtha there is delayed precipitation of asphaltene and because of the corrosive nature of naphtha the pipeline is subject to corrosion. Additionally, naphtha is a high value product that would be better tasked as an ingredient in jet fuel rather than adding it to crude to enable pipeline transport. The API of the blend of Venezuelan crude is calculated to be 26 by working back from the 10% dose of naphtha and an API gravity of 30 degrees required to allow pipeline (100*(30)=90*X+10*(65)).

The above table shows that the API degree of a crude oil that has no asphaltene is estimated to be the light crude oil with an estimated value of 65 degrees: the API of naphtha. Based on data presented, to produce an intermediate crude oil with an API gravity of 30 degrees for pipeline transport, an intermediate crude oil with API degree of 25 required twenty nine percent (29%) of dosage of the oxolane, a mono-cyclic ether, that is required for a heavy crude oil with API gravity of 8 degrees. There is an equivalency between the dose of and the quantity of asphaltene that is to be destructed be pipeline ready crude at an API Gravity of 30 degrees. Therefore, only 28% of the asphaltene content in crude with API Gravity of 8 degrees is present in a crude with API Gravity of 25 degrees. The estimated cost of treatment with oxolane, a mono-cyclic ether, at 1 part to 725 parts of crude oil, based on a cost of $75 a gallon, is $5.80 a barrel.

As stated above, the current practice in Venezuela is to allow pipeline transport of Merey-16, API gravity of 16 degrees, is by blending heavy naphtha at a dose of 10% by volume at a cost of $1.50 per gallon ($6.30 per barrel) and deal with the nagging problem of Delayed Asphaltene Precipitation (DAP). DAP is avoided when the Merey-16 crude is treated with the mono-cyclic Ether, oxolane, at one part to 725 parts of crude to allow pipeline transport at a cost of $75.00 per gallon ($5.80 per barrel). Also in Venezuela, required is approximately one third (⅓), by volume, of heavy naphtha, API gravity of 55 degrees, for blending with Merey-16, API Gravity of 16 degrees, to produce "refinery ready" crude. Heavy naphtha at a dose of 33% by volume at a cost of $1.50 per gallon ($21.00 per barrel) and deal with the nagging problem of delayed asphaltene precipitation (DAP).

Process Diagram

Two of the many embodiments of the present invention are shown in FIG. 9. Numerous other embodiments are possible to practice the present invention. All embodiments of the present invention start with linoleic fatty acid (18:2) obtained from vegetable oils. Typical compositions of some vegetable oils are contained in the following table on a weight percent basis.

| | Soy | Corn | Canola | Palm | Voila ™ |
|---|---|---|---|---|---|
| Saturated | | | | | |
| 12:0-Lauric | | | | 0.25 | |
| 14:0-Myristic | | | | 0.12 | |
| 16:0-Palmitic | 10 | 80 | | 42.5 | 2 |

-continued

| | Soy | Corn | Canola | Palm | Voila ™ |
|---|---|---|---|---|---|
| 18:0-Stearic | 4 | 14 | | 4.6 | 13.6 |
| 20:0-Arachidic | | 3 | | 0.25 | |
| Other | 1 | | | 0.19 | 0.85 |
| Unsaturated | | | | | |
| 16:1-Palmitoleic | | | | 0.2 | |
| 18:1-Oleic | 23 | | 63 | 40.8 | 26.8 |
| 18:2-Linoleic | 51 | 2.9 | 21 | 10.6 | 54.6 |
| 18:3-Linolenic | 10 | 0.1 | 9 | 0.3 | 1.3 |
| Other | 1 | | | 0.19 | 0.85 |
| Subtotal | 85 | 3 | 93 | 52.09 | 83.55 |
| Saturated Subtotal | 15 | 97 | 7 | 47.91 | 16.45 |
| Unsaturated Subtotal | 85 | 3 | 93 | 52.09 | 83.55 |
| Total | 100 | 100 | 100 | 100 | 100 |

The Source material for the present invention is linoleic fatty acid (18:2) from vegetable oil. As shown in the above table linoleic fatty acid is only found at greater than 50% concentration by volume in two oils, soybean oil and Voila™ oil. These two oils are available in sufficient quantities to be considered for use in processing the world's enormous volumes of bitumen and heavy crude oil. Voila™ oil, is a byproduct of the manufacture of corn ethanol that is mandated to be 10% of the U.S. gasoline fuel supply. It is almost ironic that the petroleum industry, that regularly lobbies to reduce the corn ethanol content in gasoline, may come to embrace the Voila™ as a weapon to solve its nagging problem of reducing the viscosity and increasing the API gravity of bitumen and heavy crude oils so that they can be refined.

Dual Cooling

In the present, invention it is desirable to increase the concentration of linoleic fatty acid (18:2) in the source material soy oil or Voila™ as a precursor to obtain a high yield of oxolane in the thermally activated reaction of the linoleic fatty acid (18:2) with methanol.

| Component | Weight, % VOILA ™ | Weight, % Soy | Melting Point, ° C. |
|---|---|---|---|
| Saturated | | | |
| Palmitic | 2 | 10 | 63 |
| Stearic | 13.5 | 4 | 70 |
| Other | 1 | 1 | |
| Total | 16.5 | 15 | |
| Unsaturated | | | |
| Oleic | 27 | 23 | 13.4 |
| Linoleic | 55 | 51 | −5 |
| Linolenic | 1 | 10 | −10 |
| Other | 0.5 | 1 | |
| Total | 83.5 | 85 | |
| Grand Total | 100 | 100 | |

The higher melting point of both saturated fatty acids than unsaturated fatty acids and higher melting point of oleic fatty acid (18:1) than that of linoleic fatty acid (18:2), can be employed in a two-stage cooling process to increase the linoleic fatty acid (18:2) content in the soy or Voila™ oil source material.

| VOILA ™ | Percent by Weight | Cold Treatment One-25° C. | Cold Treatment Two-0° C. |
|---|---|---|---|
| Saturated | 16.5 | 0 | 0 |
| Unsaturated | | | |
| Linolenic } | 27 | 32 | 0 |
| Linolenic | 56.5 | 68 | 100 |
| Other | | | |
| Total | 83.5 | 100 | 100 |
| Grand Total | 100 | 100 | 100 |

| Soy Oil | Percent by Weight | Cold Treatment One-25° C. | Cold Treatment Two-0° C. |
|---|---|---|---|
| Saturated | 15 | 0 | 0 |
| Unsaturated | | | |
| Oleic } | 23 | 27 | 0 |
| Linolenic | | | |
| Linolenic | 61 | 72 | 98 |
| Other | 1 | 1 | 2 |
| Total | 85 | 100 | 100 |
| Grand Total | 100 | 100 | 100 |

First, the oil is cooled to a temperature below the melting point of palmitic fatty acid (16:0), 63° C., and above the melting point oleic fatty acid, 13.4° C. In one embodiment of the present invention, the first stage cooling temperature is 25 C. At this temperature, if 100% of the saturated fatty acids were removed from the oil, the linoleic/linolenic fatty acids (18:2/18:3) content would increase to 72% for soy oil and 68% for VOILA™. Second, the oil is further cooled to a temperature below the melting point of oleic fatty acid (18:1), 13.4° C., and above the melting point of linoleic fatty acid (18:2), −5° C. In one embodiment of the present invention the second stage cooling temperature is 0° C. At this temperature, if 100% of the oleic fatty acids were removed from the oil, the linoleic/linolenic fatty acids (18:2/18:3) would increase to 98% for both soy oil and for VOILA™. VOILA™ is preferred to soy oil as a source material because before cooling process, the ratio of linoleic/linolenic fatty acids (18:2/18:3) is 55:1 versus 5.1:1 making more linoleic fatty acids available to produce oxolane.

Soy based saturated fatty acids are a feedstock used to meet the twenty five percent (25%) minimum bio content requirement for biodegradable motor oil that has been mandated for use in U. S. Government vehicles. The first stage cooling produces saturated fatty acids that after conversion to esters and removal of glycerine, are suitable for this biodegradable motor oil. If VOILA™ is the source material, rather than soy, the bio based for motor oil contains seven times the content of stearic fatty acid (18:0) as compared to the palmitic fatty acid (16:0) content, rather than soy with 0.4 times the content of stearic fatty acid as compared to the palmitic fatty acid (16:0) content. Stearic fatty acids rich feedstocks are preferred to palmitic fatty acids rich feedstocks for biodegradable motor oil because steric fatty acid is more like the petroleum base mineral stocks that are blended with to produce the motor oil. First, stearic fatty acid has an 18-carbon chain length which is the mean length of the 16 to 18 carbon chain length of the petroleum base mineral stock. Second, the specific gravity of stearic fatty acid of 0.94 is in range of that of the petroleum based mineral stock rather than the incompatible specific gravity of palmitic fatty acid of 1.61.

The oleic fatty acid produced in the second stage cooling process will be processed to technical grade purity of 90% to find use in oil and gas exploration and production.

Esterification

The production of the ester methyl linoleate ($C_{19}H_{34}O_2$) from the fatty acid linolenic (18:2) is shown in FIG. 9, wherein the carboxylic group on the fatty acid reacts with an alcohol, typically methanol ($CH_3OH$), in the presence of an acid catalyst, typically hydrochloric acid, to produce the ester. The use of an acid catalyst is selected, rather than a basic catalyst, is to preserve the unsaturated bonds in the linolenic fatty acids that are vital to the production of oxolane in the subsequent reaction. The use of acid catalyst is not only more costly than basic catalysts but the reaction progresses more slowly. The process of acid esterification is Fischer esterification. Zinc (II) as a solid catalyst has been used in various compounds to reduce reaction time and may have application in embodiments of the present invention.

Reaction

The reaction to produce oxolane is shown as follows using two parts, methyl linoleate as part A and methanol is part B, when the requisite amount of heat is applied, the reaction proceeds to form oxolane.

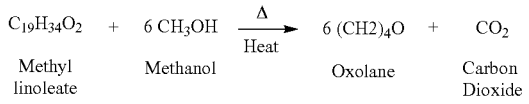

The reactant methyl linoleate is 71.7% by weight and 61.6% by volume of the total reactants. The product oxolane is 90.7% by weight of the total products of the reaction.

In Situ Production

The point at which the above reaction occurs is the point at which heat is added to the mixture containing 1.6 parts by weight of methyl linoleate to 1 part by weight of methanol. This mixture can be transported as part A and part B and then added in the above referenced proportions at the site for production of the oxolane (see FIG. 9).

The reaction occurs above ground at the inlet to the pump that moves the bitumen of heavy crude, after heating, into a storage tank. The temperature in this embodiment is 60° C. (140° F.). At this temperature the reaction proceeds as liquid because the 60° C. (140° F.) temperature is below the boiling point of the reactant methanol, 64.7° C. (148.5° F.), and the product oxolane, 66° C. (150.8° F.). The pressure in the pump, where the reaction occurs is 1 bar (14.7 psi).

The reaction occurs below ground at the inlet to the steam generator used for enhanced oil recovery of bitumen or heavy crude. The temperature in this embodiment is 300° C. to 400° C. The pressure underground at the point that the oxolane contacts the deposits is approximately 300 bar (4,400 psi).

These temperatures and pressure conditions transform solvents, oxolane and carbon dioxide, into supercritical fluids because these conditions are above the critical point for these materials. This allows the solvents to effuse through the solids, deposits of bitumen or heavy crude like a gas and to dissolve materials in the asphaltene/tar like a liquid. The extraction of the aromatic and alkane materials occurs at an accelerated rate due to the low viscosity and high diffusivity associated with supercritical fluids. A secondary effect is that particles of asphaltene are reduced in size by the supercritical fluids to the nanoscale so that there is no possibility of precipitation of asphaltene, a condition that commonly occurs when heavy crude oil is blended with light crude oil or distillates, after oxolaned enriched steam.

Experiment One—Natural Solvent Methyl 9-Dodecenoate

Methyl 9-dodecenoate ($C_{13}H_{24}O_2$) is a natural solvent with a Kauri-butanol value of 85. A commercially available product containing this solvent at 50% by volume was used to treat Venezuelan heavy crude oil for Block C North and it was determined that a 10% by weight of this product was required to produce a crude oil that was suitable for transportation. The Kauri-butanol value for the mono-cyclic ether solvent oxolane of 850 is ten times that of the natural solvent. The dose and Kauri-butanol value of the natural solvent is used to forecast the dose of the oxolane required to be treat the Venezuelan heavy crude oil with 1 part of the oxolane solvent to 200 parts of crude is equivalent to 27 ounces oxolane solvent per barrel of crude.

At a cost of the mono-cyclic ether solvent oxolane of one hundred dollars (−$75) per gallon the cost of treatment of the Venezuelan heavy crude oil, with API Gravity of 8 degrees is $21 a barrel. Shown in FIG. 8 is that the asphaltene content, that is to be removed to achieve an API Gravity of 30 degrees, for crude with API gravity of 8 degrees is 1.07 pounds per gallon and the asphaltene content, that is to be removed to achieve an API Gravity of 30 degrees, of crude with API gravity of 25 degrees is 0.07 pounds per gallon. There is an equivalency between the dose of the mono-cyclic ether solvent oxolane and the quantity of asphaltene that is to be destructed to produce refinery ready crude at an API gravity of 30 degrees. Therefore, only 28% of the asphaltene present in crude with API gravity of 8 degrees is present in a crude with API of 25 Degrees. So, at a cost of the solvent oxolane was seventy five dollars (−$75) per gallon, the cost of treatment of the Venezuelan heavy crude oil with API of gravity of 25 degrees is $5.88 a barrel.

Experiment Two—Mono-Cyclic Ether Solvent Oxolane

As previously mentioned, the specific gravity of a crude oil with API gravity of 8 degrees, such as the Venezuelan heavy crude oil for Block C North, @ 60° F., is 1.0140. The crude sample is placed by spoon into two vials containing 1.35 ounces (40.5 gm) that are labeled 1, and 2. Sample 2 is the reference sample to be untreated. The samples are placed into a crock pot fill with water and the temperature is measured and the electrical heater control is adjusted to bring and maintain the water bath to 82° C. (180° F.). This is the temperature to which Venezuelan heavy crude oil is heated to allow transport. A crude oil with API of 8 degrees with a viscosity of 5,000 cP measured at the standard temperature of 100° F., thins to achieves a viscosity of 400 cP when heated to 82° C. (180° F.). A dose of 1.0 milliliters of reagent grade of the mono-cyclic ether solvent, oxolane, is added to Sample 1 at, weight/weight, of solvent to crude of 1:45. The API gravity of the sample before/after treatment is measured to determine API gravity conforming to ASTM D-1250 and reported below.

| Sample | Dose | API |
|---|---|---|
| 1 | 1/45 | 13.0 |
| 2 | None | 8.0 |

Venezuela exports two grades of crude oils. One is refinery ready crude oil with API gravity of 30 degrees and the other is Merey-16 heavy crude with a typical API gravity of 16.3 degrees. The above tests results are extrapolated to estimate the performance of the mono-cyclic ether solvent, oxolane to convert Merey-16 heavy crude into refinery ready crude oil with API gravity of 30 degrees. These results are shown in FIG. 8 where in the change in API gravity from 8.0 to 13.0 degrees results from a decrease in the asphaltene content of 6.13% is used to predict that a 4.33% reduction in asphaltene content of the Merey-16 heavy crude with API of 16.3 degrees can be upgraded to refinery ready crude oil with API gravity of 30 degrees from a decrease in asphaltene content of 4.33%.

Experiment Three—Lake Guanoco Crude's Deconstruction of Asphaltene Lake Guanoco is one of the world's five natural tar lakes. It has an API gravity of 4 degrees. The crude is shown in the upper photo of FIG. 10. The crude undergoing treatment is shown in the bottom photo of the figure. Note the two rings formed around the central glob of Guanco crude oil. This is a visual of the process of deconstruction of the crude with the reaction progressing as the blob is undergoing decomposition by the relatively clear liquid that contains two milliliters of the mono-cyclic ether solvent (oxolane). The crude is transformed into the lighter crude, in the outer ring, as heavier crude, in the central ring, is deconstructed by the relatively clear liquid contained in the intermediate ring. The small volume of the oxolane dose is augmented by the volume of the n-heptane and toluene: these are the fractional building blocks of the asphaltene that are liberated when the oxolane oxidizes the resin compounds that form a shell surrounding the asphaltene and liberate the n-heptane and the toluene. The outer ring contains the new general population of compounds, the lighter crude oil, that tests to a higher API gravity than the heavy crude oil in the inner ring and this new crude has the added benefit on improved pipeline transport as a direct result of the spontaneous blending of the crude with the internally generated n-heptane and toluene.

Experiment Four—Lake Guanoco Crude's Visual Proof

A dollop of the Lake Guanco natural tar, with API gravity of 4 degrees, was placed in a drinking glass containing water, at a temperature of 100° F., the dollop was observed to sink to the bottom of the glass. The dollop sank because the API gravity was less than an API gravity of 10, that is the point on the API gravity scale where materials with this value are neutral buoyant.

One hundred grams of the Lake Guanco natural tar was first heated to 150° F. and then blended, over two minutes, as twelve millimeters of oxolane was added. After the treated tar cooled to 100° F., a quantity of the treated tar was spooned into a second drinking glass containing water, at a temperature of 100° F. The tar was observed to float on top of the water because the API gravity was greater than an API gravity of 10, that is the point on the API gravity scale where materials with this value are buoyant.

This relatively simple experiment demonstrates that blending the tar with oxolane increase the API gravity of the tar.

Ultra Sound and Sulfur Removal

In a preferred embodiment of the present invention, ultrasound is used to reduce the requisite dose of the mono-cyclic ether solvent to increase the API of the crude oil being reacted with the solvent. When augmented by ultrasound the solvent's oxidation of the resin "shell" that surrounds the asphaltene occurs in combination with the oxidation of the sulfur content of the crude oil. The sulfur is present in the crude as mercaptans, sulfides, disulfides and thiophenes. The conditions for operation of the ultrasound are frequency in the range of 20 to 50 KHz and power in the range of 5 to 100 watts per square centimeter.

REFERENCES

Alboudwarej, H, et al., "Highlighting Heavy Oil" Oilfield Review, pp 34-54 (2006).

Buckley, J. S. and Wang, J. "Crude Oil and Asphaltene Characterization for Prediction of Wetting Alteration" Journal of Petroleum Science and Engineering, Vol. 33, Issue 1-3, pp 195-202 (2002).

Speight, J. "The Chemistry and Technology of Petroleum", CRC Press (1999).

What is claimed is:

1. A method to increase the American Petroleum Institute (API) Gravity of bitumen or crude oil by reacting one or more alcohol ethoxylate compounds, from the group with C-9, C-10, and C-11 carbon chain lengths, with bitumen or crude oil, where the reaction occurs above ground, with the alcohol, or blend of alcohols, added at the inlet to a pump, at ambient temperature and pressure, that moves bitumen or heavy crude into a storage tank.

2. The method according to claim 1, wherein the dose of alcohol ethoxylate compounds, from the group with C-9, C-10, and C-11 carbon chain lengths, to achieve a comparable increase in API Gravity for a crude oil or bitumen, is reduced by the application of ultrasound, operating in a frequency range of greater than 20 kilohertz and less than 50 kilohertz and in a power range equal to a minimum of 5 watts and a maximum of 100 watts, to reduce the sulfur content of the crude oil or bitumen prior to the addition of the alcohol or alcohol blend.

3. A method to increase the American Petroleum Institute Gravity of bitumen or crude oil by reacting one or more alcohol ethoxylate compounds, from the group with C-9, C-10, and C-11 carbon chain lengths, with bitumen or crude oil, where the reaction occurs below ground, with the alcohol, or blend of alcohols, added at the inlet to a steam generator, at elevated temperature and pressure, and the reaction products are subsequently contacted with bitumen or crude oil content resident in a reservoir or oil bearing stratum.

4. A method to increase the American Petroleum Institute Gravity of bitumen or crude oil by adding oxirane, ethylene oxide, and one or more alcohols in the range of 1 to 10 carbons, methanol to decanol, to the inlet to a steam generator to manufacture alcohol ethoxylate compounds that are subsequently contacted with bitumen or crude oil content resident in a reservoir or oil bearing stratum.

* * * * *